US005255726A

United States Patent [19]

Hasegawa et al.

[11] Patent Number: 5,255,726

[45] Date of Patent: Oct. 26, 1993

[54] SUBSTANTIALLY UNCURVED AND UNWAVED PLYWOOD PRODUCED BY USING VENEERS WITH UNSTRAIGHT FIBERS AND METHOD FOR PRODUCING SUCH A PLYWOOD

[75] Inventors: Katsuji Hasegawa, Ohbu; Yoshinori Koba, Tokai; Norio Shibagaki; Akira Itoh, both of Ohbu; Matsunaga Tsuruta, Aichi, all of Japan

[73] Assignee: Meinan Machinery Works, Inc., Ohbu, Japan

[21] Appl. No.: 870,805

[22] Filed: Apr. 17, 1992

Related U.S. Application Data

[62] Division of Ser. No. 464,415, Jan. 12, 1990, abandoned.

[30] Foreign Application Priority Data

Jan. 13, 1989 [JP] Japan ..... 1-6589

[51] Int. Cl.[5] ..... B27C 1/00

[52] U.S. Cl. ..... 144/365; 144/3 R; 144/193 E; 144/215; 144/346; 144/367; 144/368; 156/83; 156/264; 428/105; 428/106

[58] Field of Search ..... 428/105, 106, 109, 113; 156/83, 264; 144/3 R, 2 R, 209 R, 213, 215, 332, 345, 346, 360, 367, 368, 365, 181, 184, 193 E

[56] References Cited

U.S. PATENT DOCUMENTS

| | | | |
|---|---|---|---|
| 1,662,314 | 3/1928 | Hyland . | |
| 3,970,497 | 7/1976 | Glover | 428/106 |
| 4,776,376 | 10/1988 | Jaeger | 144/366 |
| 4,934,228 | 6/1990 | Bolton et al. | 144/367 |
| 4,989,651 | 2/1991 | Snellgrove | 144/367 |

FOREIGN PATENT DOCUMENTS

| | | | |
|---|---|---|---|
| 561118 | 1/1932 | Fed. Rep. of Germany . | |
| 1195303 | 11/1959 | France | 144/365 |
| 425211 | 11/1986 | Switzerland . | |
| 1502530 | 7/1976 | United Kingdom . | |

OTHER PUBLICATIONS

SU 1207-766-A; Abstract.

*Primary Examiner*—W. Donald Bray
*Attorney, Agent, or Firm*—Lahive & Cockfield

[57] ABSTRACT

A substantially uncurved and unwaved plywood includes at least one pair of veneers located symmetrically with respect to a middle of a thickness of the plywood and having unstraight grains which coincide with each other.

A method for producing a substantially uncurved and unwaved plywood comprises locating at least one pair of veneers with identical unstraight grains in a pair of positions symmetrical with respect to a middle of a thickness of a plywood to be produced, in such a manner than the grains of the veneers coincide with each other.

A simple method for continuously preparing pairs of veneers with identical unstraight grains comprises (i) peeling from a cylindrical log with unstraight fibers a continuous sheet of twice a thickness of each one of a pair of veneers to be prepared, (ii) cutting the sheet into a predetermined length to provide a thick veneer, and (iii) slicing the thick veneer at a middle of a thickness thereof to prepare a pair of veneers with equal thicknesses and with identical unstraight grains. Another simple method for continuously preparing pairs of veneers with identical unstraight grains includes slicing the continuous sheet before cutting into the predetermined length.

Other methods for continuously preparing pairs of veneers with identical unstraight grains are also disclosed.

13 Claims, 8 Drawing Sheets

SUBSTANTIALLY UNCURVED AND UNWAVED PLYWOOD PRODUCED BY USING VENEERS WITH UNSTRAIGHT FIBERS AND METHOD FOR PRODUCING SUCH A PLYWOOD

This is a divisional of copending application Ser. No. 464,415 filed on Jan. 12, 1990, now abandoned.

FIELD OF THE INVENTION

This invention relates to a substantially uncurved and unwaved plywood produced by using veneers with unstraight fibers and a method for producing such a plywood, and additionally relates to a method for continuously preparing pairs of veneers with identical unstraight grains.

BACKGROUND OF THE INVENTION

Heretofore veneers for plywoods have been cut from logs having properties suitable for the production of plywoods. Logs with the suitable properties are mostly obtained in Asian torrid zones. The suitable properties include the capability of being readily bonded to wood with an adhesive material, the capability of drying in a relatively short period of time, the property of not emitting an offensive odor, and in particular the property of being substantially composed of straight fibers.

Usually an odd number of veneers are used for the production of a plywood. For the production of a three-layer plywood, two veneers (of the same thicknesses) are bonded to the opposed sides of a core veneer such that the fibers of the two outer veneers run at right angles to the fibers of the core veneer. From a different point of view, the fibers of the two outer veneers run in the same direction. Similarly a five-layer plywood consists of a core veneer whose fibers run in one direction, two outer veneers bonded to the opposed sides of the core veneer such that the fibers of the two outer veneers run in the same direction, making right angles to the fibers of the core veneer, and two outermost veneers bonded to the two outer veneers, respectively, such that the fibers of the two outermost veneers run in the same direction, making right angles to the fibers of the two outer veneers. Also, a plywood is produced in such a manner that a neutral plane of the plywood, i.e., the plane of the plywood where the plywood is not subjected to expansion and contraction, is located at the middle of the thickness of the plywood.

Heretofore, however, if veneers with unstraight fibers are used, a normal plywood has not been produced since, as a matter of course, it is not possible to place such veneers on one another such that the fibers of the adjacent ones of them make right angles with each other. The use of such veneers have resulted in a curved or waved plywood. Needless to say, veneers with unstraight fibers come from logs with unstraight fibers. Therefore, logs with unstraight fibers hitherto have not been used for the production of plywoods.

However, since a great deal of wood resources have been exploited in the past, there is now the necessity to use even logs with unstraight fibers for the production of plywood. To meet this necessity, the applicant proposed veneer lathes disclosed in Japanese Patent Publications Nos. 56-16729 and 59-19007 and a rotary lathe disclosed in Japanese Patent Publication No. 61-21805. However, these lathes in themselves are not capable of producing veneers usable for the production of uncurved and unwaved waved plywoods, from logs with unstraight fibers.

Unstraight fibers include diagonal fibers, spiral fibers, interlocked fibers and wavy fibers.

Some of the reasons why the use of veneers with unstraight fibers results in a curved or waved plywood will now be described.

One of the reasons resides in a behaviour of a veneer. The mechanical strength of a veneer is much smaller in its direction perpendicular to its fibers than in its direction of the fibers. Therefore, for example, if a veneer absorbs a large amount of moisture, the veneer expands much more in its direction perpendicular to its fibers than in its direction of the fibers. Thus, with a veneer having unstraight fibers, different portions thereof with fibers running in different directions expand or contract in different directions. For this reason, if such veneers are used to produce a plywood, a curved or waved plywood may result.

Another reason relates to a behaviour of an adhesive material. For the production of a plywood, veneers are bonded together with an adhesive material. A typical adhesive material is a liquid, thermosetting adhesive material containing synthetic resin (such as urea resin, melamine resin or phenolic resin) or denaturalized, copolycondensed or mixed resin obtained by using the synthetic resin. Such a type of adhesive material contains a large amount of solvent, such as water. In addition, where necessary, an additional solvent (such as water), an extending agent (such as wood dust or wheat flour), a curing agent (such as ammon chloride), a filler, a thickening agent and/or a plasticizer is added to the adhesive material. Then, the adhesive material is applied to a veneer, and the veneer is bonded to another veneer while the whole is heated. The adhesive material is thus hardened as part of the solvent contained in the adhesive material is absorbed, together with part of the other portion of the adhesive material, in the veneers and the remaining part of the solvent evaporates from the adhesive material. Consequently the adhesive material shrinks considerably.

After the adhesive material has been applied to the veneer, the veneer swells. But as the adhesive material shrinks, the veneer also shrinks. However, the veneer shrinks only in its weaker direction, i.e., in its direction perpendicular to its fiber. Also, the veneer swells once again as it absorbs the vapor of the solvent produced from the adhesive material. Therefore, the veneer is not capable of shrinking in exactly the same manner as the adhesive material. Consequently, the veneer is considerably compressed.

Thus, the veneer shrinks to a certain degree in its direction to its fibers. However, if the veneers are bonded together such that a product (plywood) has a neutral plane at the middle of the thickness of the product, the shrinkage of the veneers does not result in a curved or waved product unless there are substantial differences in the directions and/or degrees of shrinkages between the corresponding portions of the upper half and lower half into which the product may be divided with respect to the neutral plane thereof. If veneers with straight fibers are used to produce a plywood, a curved or waved plywood does not result since there are no substantial differences in the directions and degrees of shrinkages between the corresponding portions of the symmetrical pair of veneers. But, if veneers with unstraight fibers are used, a curved or waved plywood result since there are substantial differences in the directions of shrinkages between different portions of each such veneer with the result that the directions and degrees of shrinkages of the different portions of one of the symmetrical pair of veneers differ substantially from the directions and degrees of shrinkages of the corresponding different portions of the other veneer.

SUMMARY OF THE INVENTION

The inventors hereof have conducted experiments and investigations to develop a technique for producing a substantially uncurved and unwaved plywood by using veneers with unstraight fibers. As a result, the inventors have found that veneers with unstraight fibers may be used to produce a substantially uncurved and unwaved plywood if such veneers are arranged in symmetrical positions about the core veneer in such a manner that the grains of such veneers coincide with each other. The method of arranging such veneers in such a manner is very simple. That is, if one is able to obtain two veneers with identical unstraight grains, one is able to locate such veneers in the foregoing manner.

The term "grain" of a veneer is herein used to mean the detailed arrangement of the fibers of a veneer.

According to the invention, if, for example, a three-layer plywood is to be produced, a pair of veneers with identical unstraight grains are bonded to the opposed sides of a core veneer such that the grains of the partnered veneers coincide with each other. In this case the partnered veneers may be called a "symmetrical" pair of veneers with respect to the core veneer. Similarly, if a five-layer plywood is to be produced, a first pair of veneers with identical unstraight grains are bonded to the opposed sides of a core veneer such that the grains of the partnered veneers coincide with each other, and a second pair of veneers with identical unstraight grains are bonded to the first pair of veneers, respectively, such that the grains of the second partnered veneers coincide with each other. In this case it may be said that the first pair of veneers is a first "symmetrical" pair of veneers with respect to the core veneer and the second pair of veneers is a second "symmetrical" pair of veneers with respect to the core veneer.

The reason why a substantially uncurved and unwaved plywood may be produced by bonding two veneers with identical unstraight grains to the opposed sides of a core veneer such that the grains of the two outer veneers coincide with each other is that the directions and degrees of shrinkages of the different portions of one of the two outer veneers are substantially the same as the directions and degrees of shrinkages of the corresponding different portions of the other outer veneer.

It is an object of the invention to provide a substantially uncurved and unwaved plywood including at least one pair of veneers located symmetrically with respect to a middle of a thickness of the plywood and having unstraight grains which coincide with each other.

Another object of the invention is to provide a method for producing a substantially uncurved and unwaved plywood, which comprises locating at least one pair of veneers with identical unstraight grains in a pair of positions symmetrical with respect to a middle of a thickness of a plywood to be produced, in such a manner that the grains of the veneers coincide with each other. According to one aspect of the invention, a pair of veneers having identical unstraight grains and not dried to a moisture content of less than 35% may be located such that the veneers form opposed outermost layers of a plywood to be produced.

Still another object of the invention is to provide a method for continuously preparing pairs of veneers with identical unstraight grains, which comprises (i) peeling from a cylindrical log with unstraight fibers a continuous sheet of twice a thickness of each one of a pair of veneers to be prepared, (ii) cutting the sheet into a predetermined length to provide a thick veneer, and (iii) slicing the thick veneer at a middle of a thickness thereof to prepare a pair of veneers with equal thicknesses and with identical unstraight grains.

A further object of the invention is to provide a method for continuously preparing pairs of veneers with identical unstraight grains, which comprises (i) peeling from a cylindrical log with unstraight fibers a continuous sheet of twice a thickness of each one of a pair of veneers to be prepared, (ii) slicing the sheet continuously at a middle of a thickness thereof, and (iii) cutting the sliced portion of the sheet into a predetermined length to prepare a pair of veneers with equal thicknesses and with identical unstraight grains.

Still further object of the invention is to provide a method for continuously preparing pairs of veneers with identical unstraight grains, which comprises (i) peeling a first continuous layer of a predetermined thickness from a cylindrical log with unstraight fibers at a position adjacent to a circumference of the log, (ii) cutting the sheet into a predetermined length to provide a first veneer, (iii) peeling a second continuous layer of the same thickness as the first continuous layer which has extended along the first continuous layer in a position immediately inside the first continuous layer, from the log at another position adjacent to the circumference of the log, the first and second continuous sheets being peeled while the log is continuously rotated, and (iv) cutting the second continuous sheet into the same length as the first continuous layer to produce a second veneer with an unstraight grain identical to the unstraight grain of the first veneer.

Another object of the invention is to provide a method for continuously preparing pairs of veneers with identical unstraight grains, which comprises (i) making slits of depths equal to twice the thickness of each one of a pair of veneers to be prepared, in a cylindrical log with unstraight fibers along an axial direction thereof with predetermined intervals along the circumference of the log, (ii) peeling the log from a middle of the depth of a first slit thereof to a middle of the depth of a second slit thereof at a position adjacent to the circumference of the log, thereby providing a first veneer, and (iii) peeling the log from a bottom of the first slit to a bottom of the second slit at another position adjacent to the circumference of the log, thereby producing a second veneer with the same length, thickness and unstraight grain as the first veneer.

BRIEF DESCRIPTION OF THE DRAWING

FIG. 3 is an enlarged view of a portion b of a veneer with an unstraight grain identical to the unstraight grain of the veneer a;

DETAILED DESCRIPTION OF PREFERRED EMBODIMENTS

Figure 1B:
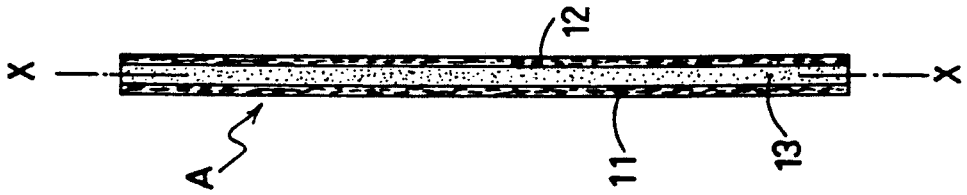
FIGS. 1A and 1B shows a method of the invention for producing a substantially uncurved and unwaved plywood A.
Figure 1A:
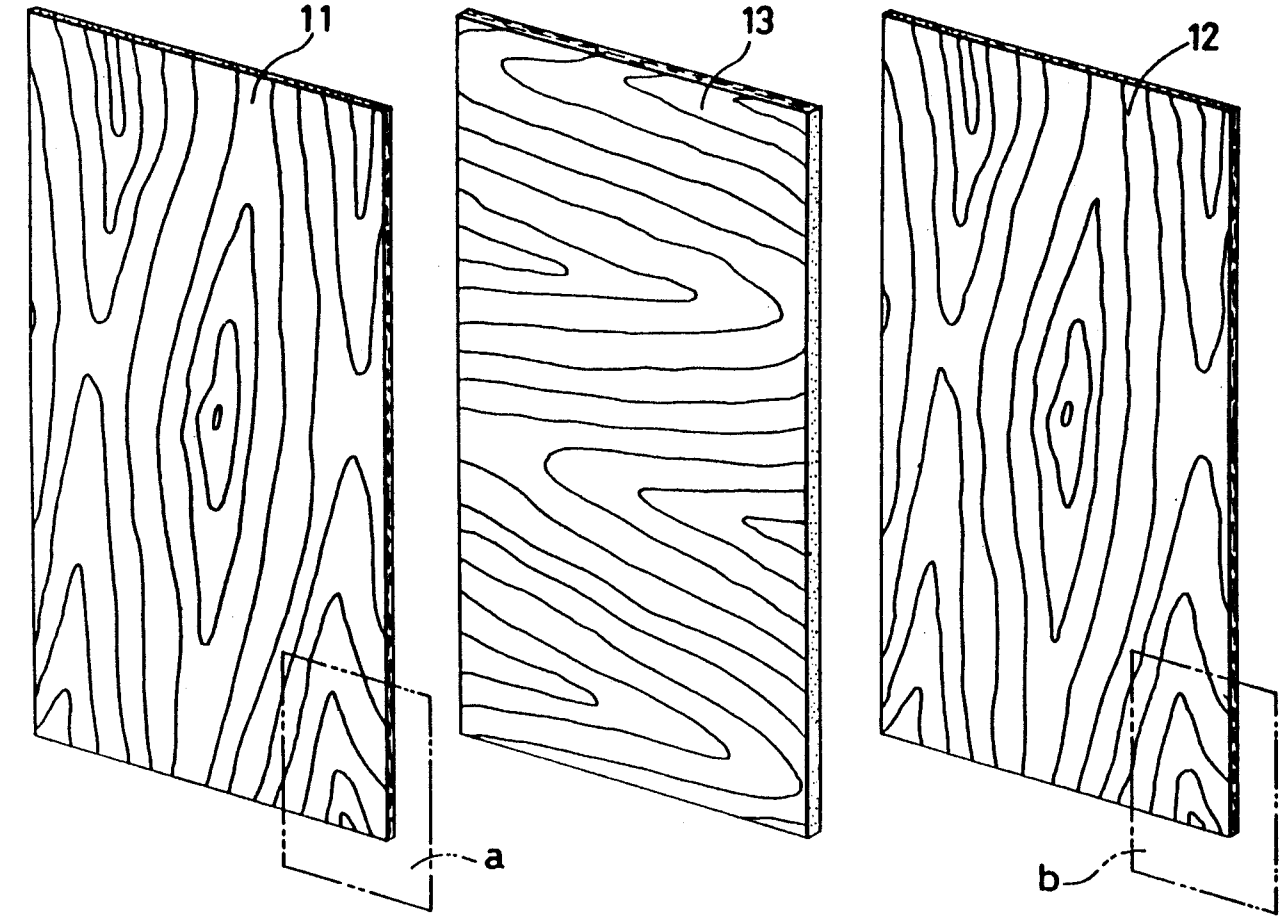

Needless to say, it is desirable to show the grains of veneers exactly as they are to describe the invention in detail. However, in actuality, it is not possible since the grain of a veneer is very delicate and complex. Therefore, the arrangements of fibers of veneers generally represented by the annual rings thereof are shown in FIGS. 1A and 1B. Incidentally, if the grain of a veneer is identical to the grain of another veneer, the pattern represented by the annual rings of the two veneers may or may not be identical. However, if the pattern represented by the annual rings of a veneer is identical with the pattern represented by the annual rings of another veneer, the grains of the two veneers are identical.

Figure 2:
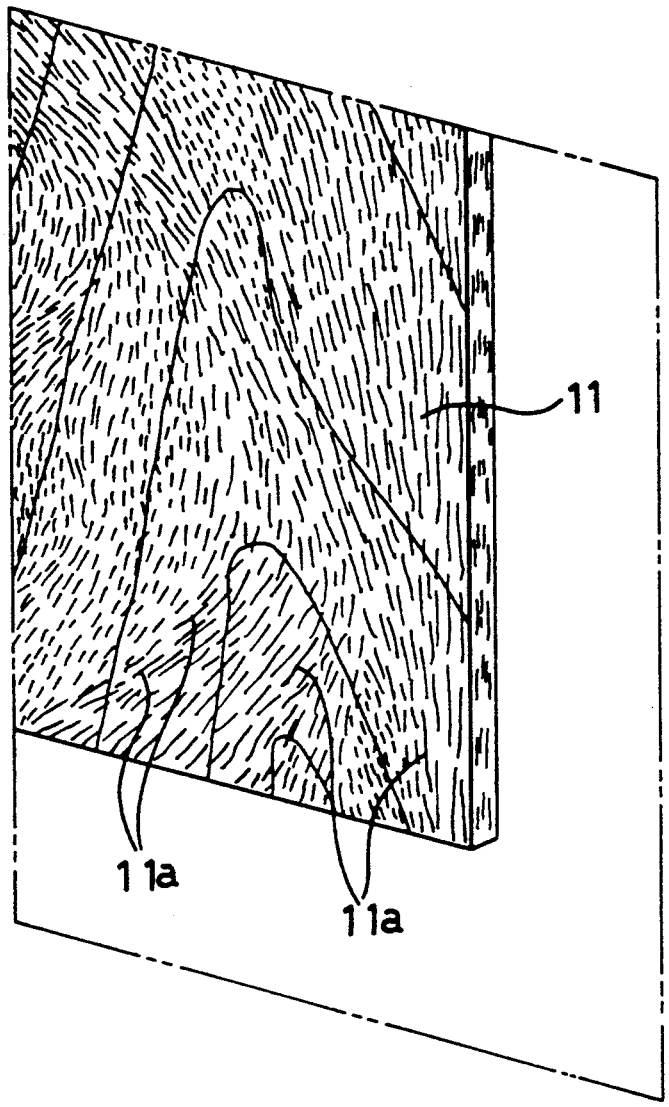
FIG. 2 is an enlarged view of a portion a of an unstraight-grained veneer of FIG. 1.
Figure 3:
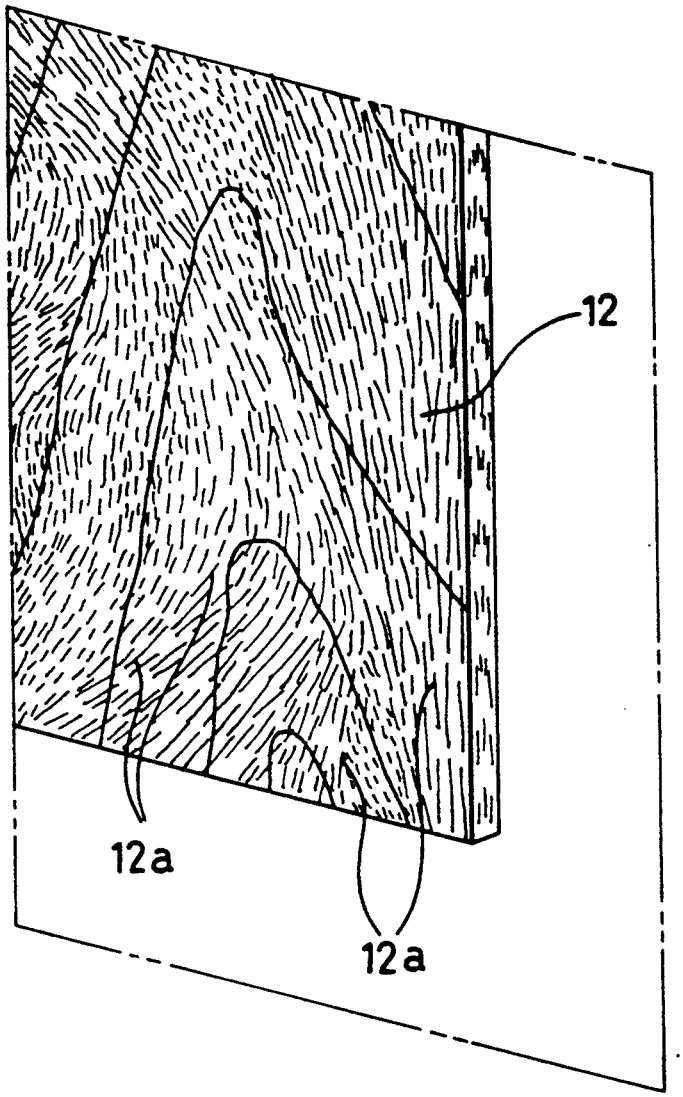

Referring to FIGS. 1A and 1B, according to the invention, veneers 11 and 12 with identical unstraight grains and with the same thicknesses may be bonded to the opposed sides of a core veneer 13 such that the grains of the two veneers 11 and 12 coincide with each other. As a result, a substantially uncurved and unwaved three-layer plywood A, as shown in FIG. 1B, is obtained. The line X—X designates the middle of the thickness of the plywood A. In FIG. 2 the reference numeral 11*a* designates vessels of the veneer 11. Also in FIG. 3 reference numeral 12*a* designates vessels of the veneer 12.

Since the grain of each outer veneer is unstraight, the different portions of each outer veneer may shrink in different directions. However, since the grains of the two outer veneers 11 and 12 coincide with each other, the corresponding portions of the two outer veneers 11 and 12 shrink in the same directions and to the same degrees. Thus, the product A is substantially free from curvature and waving.

The core veneer 13 may be one with a straight grain or with an unstraight grain. Strictly speaking, a less curved and waved plywood may be produced if a straight-grained core veneer is used than if an unstraight-grained core veneer is used. However, a unstraight-grained core veneer is sufficient to produce a substantially uncurved and unwaved plywood.

In the embodiment of FIGS. 1A and 1B the outer veneers 11 and 12 may be called a "symmetrical pair" of unstraight-grained veneers with respect to the core veneer 13 or with respect to the middle of the thickness of the plywood. Although not shown in the drawing, an additional symmetrical pair or pairs of unstraight-grained veneers may be used to produce a plywood with five or more layers. For example, if an additional pair of veneers with identical unstraight grains and with the same thicknesses are bonded to the veneers 11 and 12, respectively, such that the grains of the additional pair of veneers coincide with each other, a substantially uncurved and unwaved five-layer plywood may be produced. Such an additional pair of veneers may be called a second symmetrical pair of unstraight-grained veneers with respect to the core veneer (or with respect to the middle of the thickness of the plywood).

Also, although not shown in the drawing, two veneers with identical unstraight grains and the same thicknesses may be bonded to the opposed sides of a usual plywood such that the grains of the two veneers coincide with each other. The "usual" plywood is a plywood produced by bonding an odd number of straight-grained veneers to one another such that the fibers of the adjacent ones of them make right angles with each other.

Figure 4:
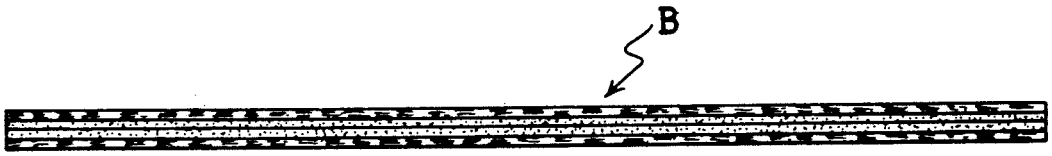
FIG. 4 is another plywood produced according to the invention.

Also, a plywood of FIG. 4 may be produced according to the invention. The plywood of FIG. 4 comprises an even number of veneers, that is, (i) a central pair of straight-grained veneers having the same thicknesses, bonded to each other such that the fibers thereof extend in the same direction, and constituting a core member and (ii) a pair of outer veneers with identical unstraight grains and the same thicknesses, which are bonded to the opposed sides of the core member such that the grains of the outer veneers coincide with each other, the outer veneers being symmetrical with respect to the middle of the thickness of the plywood.

Figure 5:
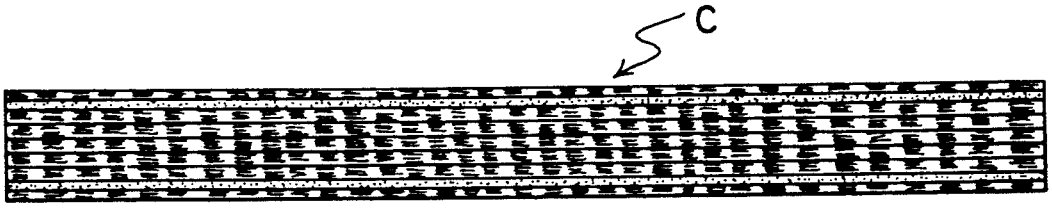
FIG. 5 is still another plywood produced according to the invention.

Moreover, a nine-layer plywood of FIG. 5 may be produced according to the invention. The plywood of FIG. 5 comprises (i) a core veneer (fifth veneer), (ii) third and fourth veneers having straight grains and orientated relative to each other such that the fibers thereof extend in the same direction, (iii) sixth and seventh veneers having straight grains and orientated relative to each other such that the fibers thereof extend in the same direction, (iv) second and eighth veneers having identical unstraight grains and the same thicknesses and orientated with relative to each other such that the grains thereof coincide with each other, and (v) first (or uppermost) and ninth (or lowermost) veneers having identical unstraight grains and the same thicknesses and orientated with relative to each other such that the grains thereof coincide with each other. The second and eighth veneers may be called a symmetrical pair of unstraight-grained veneers with respect to the core veneer or with respect to the middle of the thickness of the plywood. The uppermost and lowermost veneers may also be called so.

Usually, before veneers are bonded together, the veneers are dried until the moisture contents thereof have been reduced to approximately 5 to 15 percent. If a roll drier may be used to dry unstraight-grained veneers, the veneers may be deformed, cracked or broken since the veneers are confined relatively loosely while being dried. Therefore, it is preferable to use such a drying apparatus as disclosed in Japanese Patent Publication for Examined Patent Application No. 61-32591, in Japanese Patent Publication for Examined Patent Application No. 61-45150, in Japanese Patent Publication for Unexamined Patent Application No. 63-46375, or in Japanese Patent Publication for Unexamined Patent Application No. 63-91477. If such a drying apparatus is used to dry an unstraight-grained veneer, the possibility that the veneer may be deformed, cracked or broken is materially reduced since such a drying apparatus confines the veneer very narrowly, engaging with as many portions of the veneer as possible or as large a surface of the veneer as possible, while drying the veneer. However, even such a type of drying apparatus cannot be used to sufficiently dry an unstraight-grained veneer to be used as a face veneer and, hence, having a relatively small thickness, without deforming, cracking or breaking the veneer. Therefore it is necessary to give up drying such an unstraight-grained veneer sufficiently. However, it has been found that even if such an unstraight-grained veneer has a moisture content of as high as 35 percent or more, such a veneer may be bonded normally to another veneer with a usual adhesive material if another veneer is a sufficiently dried one.

However, if a veneer not sufficiently dried comes into contact with iron, the veneer is polluted black. Therefore, it is necessary to use a heating plate of stainless steel or aluminum to harden the adhesive material applied to such a veneer. Also, a veneer shrinks more uniformly (as it dries) if a heating plate with plural means for piercing the veneer is used than if a usual heating plate with a flat heating surface.

A veneer, whether a straight-grained one or an unstraight-grained one, may be "tenderized" to make the veneer more pliable and more expansible and contractible. Experiments conducted by the inventors have shown that if veneers used for the invention (which may include a straight-grained veneer) are tenderized, a substantially uncurved and unwaved plywood may be effectively produced. For this purpose, the veneers for the invention may be tenderized before or after the veneers dry. However, if the veneers are tenderized before the veneers dry, it is necessary to make slits in different portions of the veneer as near to each other as possible. As is well known, a veneer is tenderized by making slits in it. The reason for the above-mentioned necessity is that, if slits are made in portions of the veneer relatively far away from each other, the slits may be enlarged as the veneer shrinks.

It is necessary to prepare a pair of veneers with identical unstraight grains to produce a substantially uncurved and unwaved plywood of the invention. Different methods for preparing a pair of such veneers will now be described.

Figure 6:
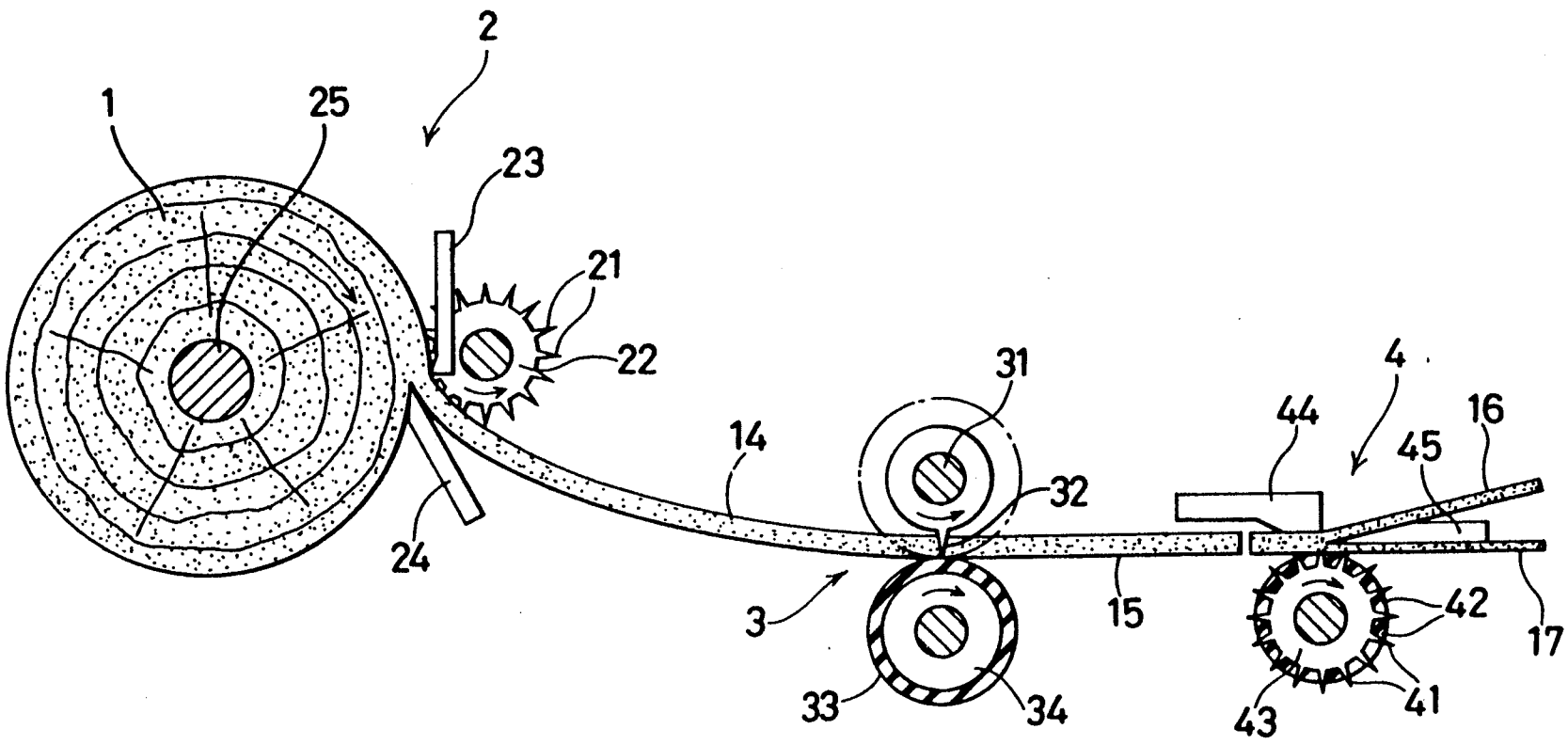
FIG. 6 shows a first method of the invention for preparing a pair of veneers with identical unstraight grains.

One method is depicted in FIG. 6. In FIG. 6 a log 1 with unstraight fibers is supported by a pair of spindles 25 at its opposed ends. Only one of the spindles 25 is shown in FIG. 6. Numeral 22 designates a driving means 22 with axially spaced-apart circular arrays of sharp-pointed projections 21. The log 1 is rotated by both the spindles 25 imparting a rotary motion to the center of the log 1 and the driving means 22 imparting a rotary motion to the circumference of the log 1. The projections 21 pierce the circumference of the log 1 as the driving means 22 is rotated. While being rotated, the log 1 is peeled with a knife 24 to produce a continuous sheet 14 of twice the thickness of each one of a pair of final products, namely, veneers with identical grains. While being peeled, the log 1 is pressed at its circumference by a pressing means 23. The spindles 25, the driving means 22, the knife 24 and the pressing means 23 constitutes a veneer lathe which has already been well known in the art. If desired, the log 1 may be rotated only by rotating the driving means 22.

The sheet 14 thus produced from the log 1 is cut by a first cutting means 3 to provide a predetermined length of sheet 15. The cutting means 3 includes a blade 32 mounted on a shaft 31 and a roll member 34 which supports the sheet and moves it to the right. The roll member 34 has an outer elastic material 33. The predetermined length of sheet 15 is conveyed to a second cutting means 4 which includes a knife 45, a pressing means 44 and a roll member 43. The roll member 43 comprises axially spaced-apart circular arrays of sharp-pointed projections 41 and annular elastic materials 42. The circular arrays of the projections 41 and the annular elastic materials are alternated with each other. As the sheet 15 is moved to the right by the roll member 43, the sheet 15 is sliced at the middle of the thickness thereof by the knife 45 to provide a pair of veneers 16 and 17 of equal thicknesses which have identical or substantially identical grains. The projections 41 of the roll member 43 pierce the bottom of the sheet 15 as the roll member 43 moves the sheet 15 to the right. Also, as the sheet 15 is moved to the right, the sheet 15 is lightly pressed from above by the pressing means 44 so that the sheet 15 is correctly cut by the knife 45.

Thus, plural pairs of veneers with identical unstraight grains may be continuously produced by using the apparatus of FIG. 6.

It is not possible to produce a pair of veneers with identical grains by a usual method for producing veneers, except when the circumference of a log (which is gradually reduced as the log is peeled) is equal to or greater than the length of each one of such veneers to be produced. Also, if the circumference of a log is greater than the length of each one of such veneers, substantial waste material may result unless the circumference of a log is equal to an integral number of times the length of each one of such veneers. However, according to the method of the invention, plural pairs of veneers with identical grains may be obtained without producing any amount or any substantial amount of waste material.

If desired, the second cutting means 4 may be located in a position further away from the first cutting means 3 than in FIG. 6, and a drying apparatus may be located between the two cutting means 3 and 4. In such an arrangement, the predetermined length of sheet 15 may be dried before cutting it in two.

If a log is not a cylindrical one, the log may be peeled by the veneer lathe of FIG. 6 to make it a cylindrical one before starting to prepare pairs of veneers with identical grains.

Figure 7:
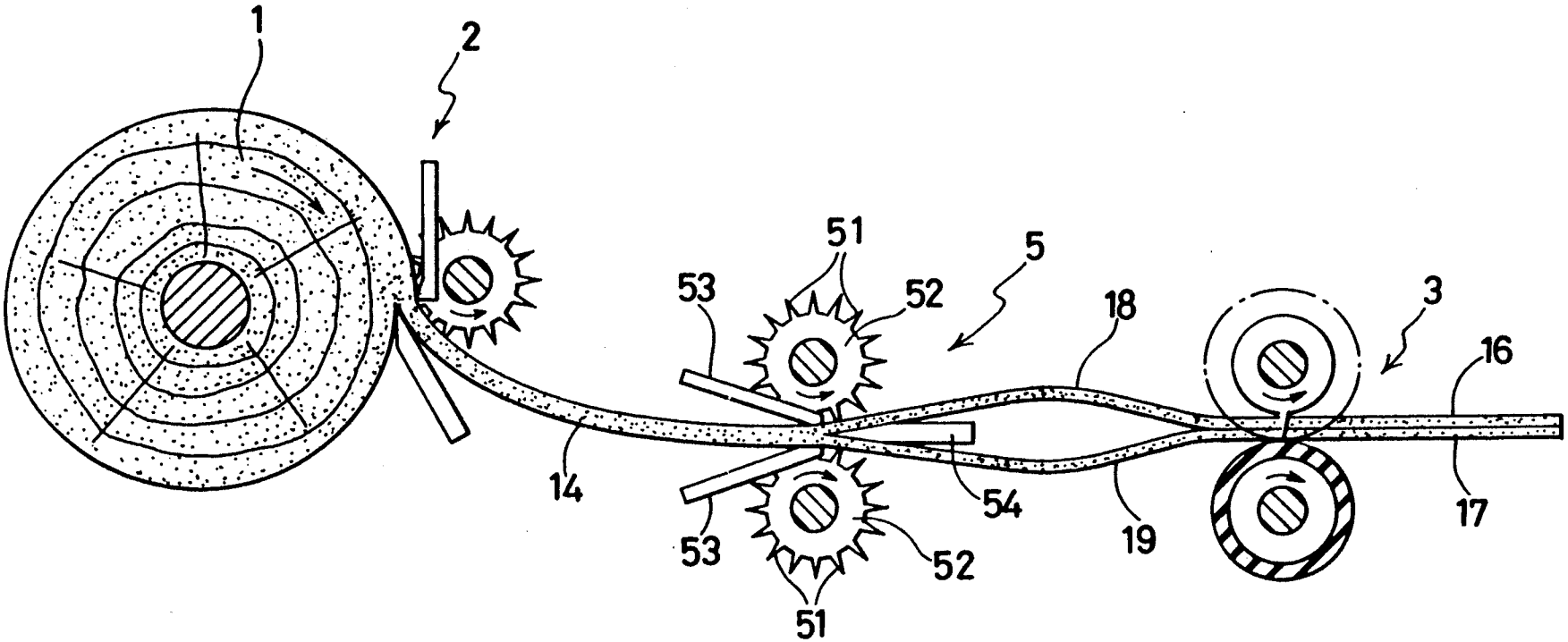
FIG. 7 shows a second method of the invention for preparing a pair of veneers with identical unstraight grains.

In FIG. 6 the original sheet 14 produced from the log 1 is cut into a predetermined length of sheet before being divided into two halves of equal thicknesses. However, If desired, the original sheet 14 may be divided into two halves of equal thicknesses before being cut into a predetermined length. FIG. 7 illustrates such a method. In FIG. 7 the original sheet 14 produced from the log 1 is cut by a first cutting means 5 into two sheets 18 and 19 of equal thicknesses. The cutting means 5 includes a pair of upper and lower roll members 52, a pair of upper and lower pressing means 53, and a knife 54. Each roll member 52 has axially spaced-apart circular arrays of sharp-pointed projections 51 which pierce the original sheet 14. The original sheet 14 is cut by the cutting means 54 as the sheet 14 is lightly pressed by the pressing means 53 and is moved to the right by the roll members 52. The two sheets 18 and 19 are cut into predetermined lengths by a second cutting means 3 which is similar to the first cutting means 3 of FIG. 6. Thus, a pair of veneers with equal thicknesses and with identical grains are obtained.

Figure 9:
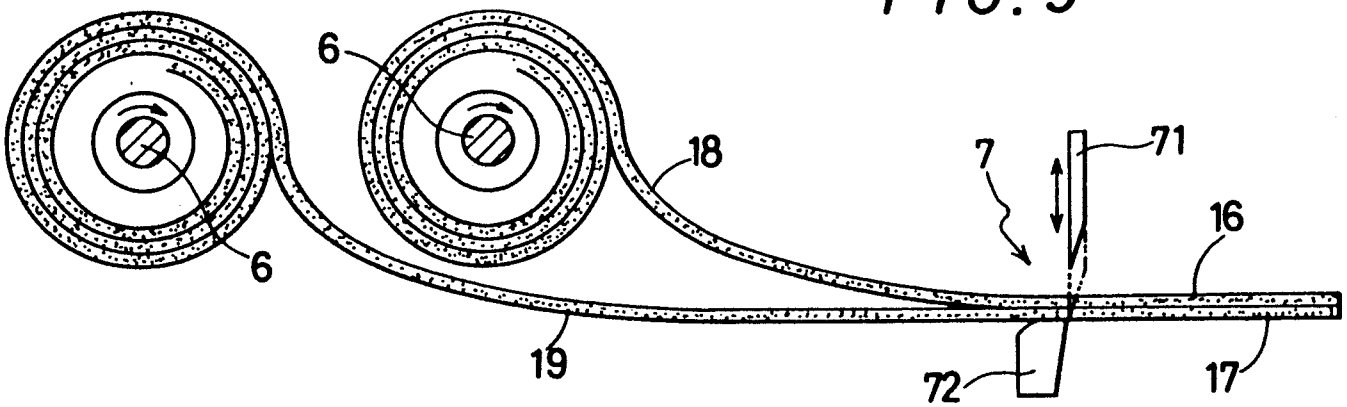
FIG. 9 shows one method for cutting continuous sheets of veneer peeled from a log into predetermined equal lengths.

If desired, the second cutting means 3 may be omitted from the apparatus of FIG. 7 and instead two separate cutting means (not shown) may be provided to cut the sheets 18 and 19 into the same predetermined lengths. Also, if desired, as shown in FIG. 9, the sheets 18 and 19 may be wound round shafts 6 and unwound therefrom and cut into the same predetermined lengths by a cutting means 7 which includes a vertically movable knife 71 and a support means 72.

It has been found that the resistance which the predetermined length of sheet 15 (FIG. 6) offers when the sheet 15 is cut into the veneers 16 and 17 is slightly smaller than the resistance which a usual log offers when the log is peeled to prepare a continuous sheet of veneer with the same thickness as the veneer 16 or 17. It is also the case when the original sheet 14 is cut into the sheets 18 and 19 (FIG. 7). Therefore, the knife 45 or 54 may have a sharper edge than the knife of a usual veneer lathe. Thus, a veneer obtained by using such a sharper knife may have a smoother surface than a veneer obtained by a usual veneer lathe. Thus, a veneer obtained by using such a sharper knife may be used as a face veneer of a plywood, for appearance sake, if its smoother surface is used as an exposed surface.

Figure 8:
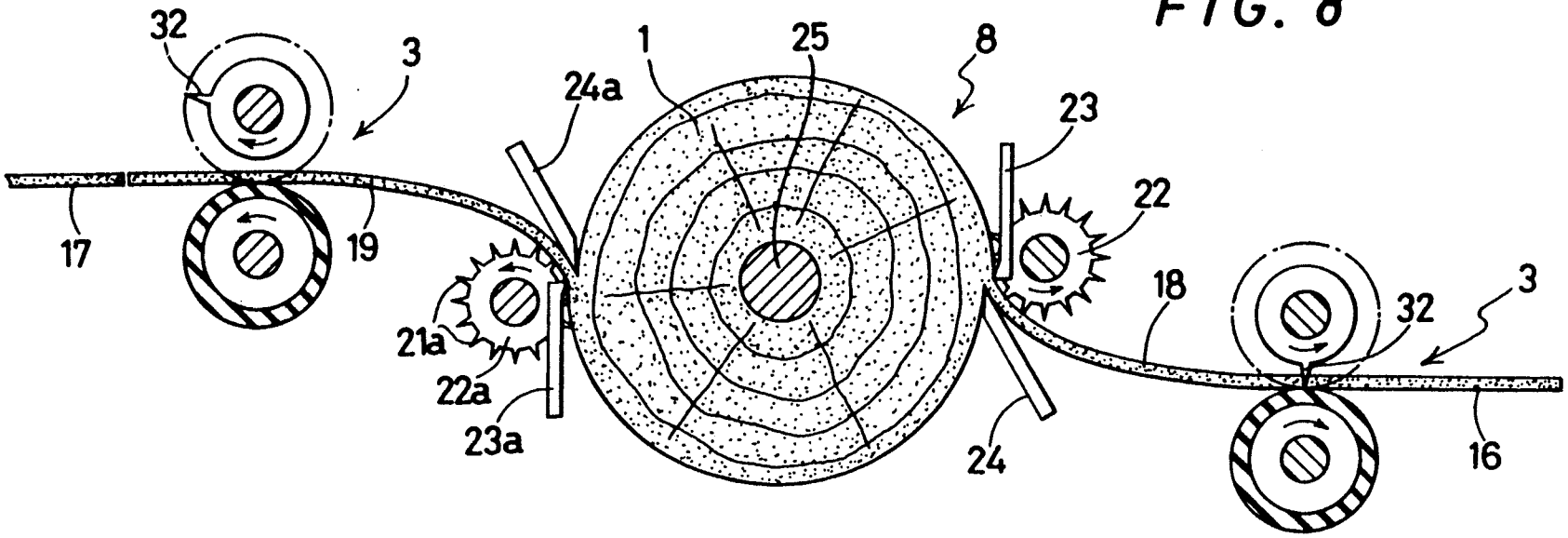
FIG. 8 shows a third method of the invention for preparing a pair of veneers with identical unstraight grains.

Another method for preparing a pair of veneers with identical unstraight grains is shown in FIG. 8. In FIG. 8 a log 1 with unstraight fibers is rotated clockwise by both a pair of spindles 25 and a pair of driving means 22 and 22*a*. A knife 24 and a pressing means 23 are associated with the right driving means 22 to provide one peeling unit. Similarly, a knife 24*a* and a pressing means 23*a* are associated with the left driving means 22*a* to provide another peeling unit. Each driving means is provided with axially spaced-apart circular arrays of sharp-pointed projections which pierce the circumference of the log 1. The two peeling units are synchronously moved toward the center of the log 1 as the two peeling units peel the log 1. The two peeling units are so located relative to each other that each peeling unit peels from the log, as it were, a "duplicate" layer, that is, a layer which has extended along and immediately inside a layer 18 or 19 peeled by the other peeling unit and has the same thickness as the latter layer. As illustrated, for example, the two peeling units may be located in diametrically opposite positions. The layer 18 (or 19) is moved in one direction, and is cut into a predetermined length by a cutting means 3 to provide a first veneer. The "duplicate" layer is moved in another direction, and is cut by another cutting means 3 into the same length as the outer layer 18 (or 19) which starts from the position thereof corresponding to the position where the leading edge of the first veneer has been located. In short, the portion of the "duplicate" layer which has extended along the first veneer in the position immediately inside the first veneer is cut from the "duplicate" layer. Thus, a pair of veneers with identical or substantially identical unstraight grains and with equal thicknesses are obtained. It will be appreciated that the second veneer may start to be cut out before the first veneer is completely cut out, depending upon the predetermined lengths of the veneers.

In the embodiment of FIG. 8 each peeling unit is moved toward the center of the log by the distance equal to twice the thickness of a sheet to be peeled from the log.

If desired, the winding means 6 and the cutting means 7 of FIG. 9 may be used for the apparatus of FIG. 8 instead of the two cutting means 3.

Figure 10:
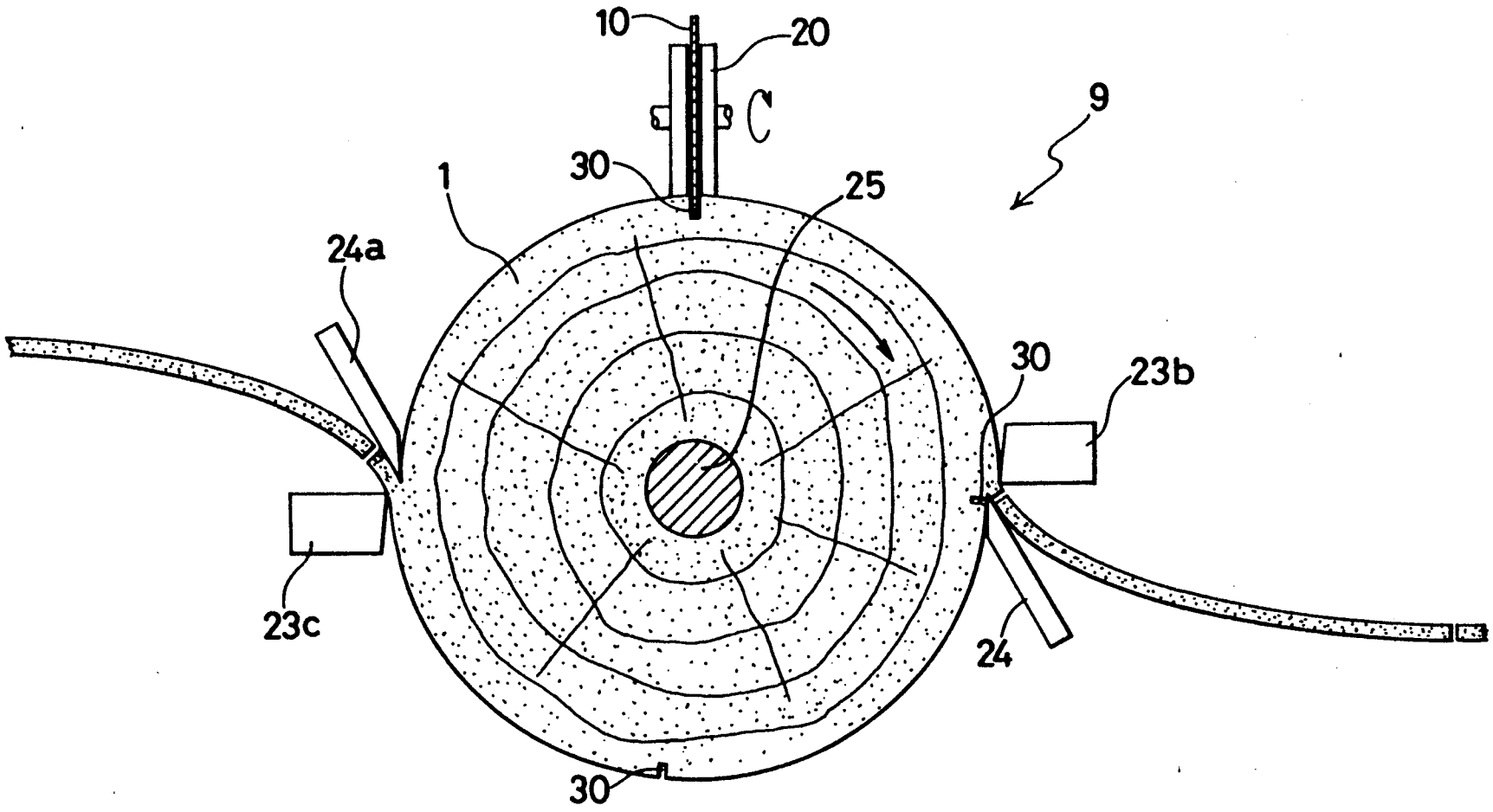
FIG. 10 shows a fourth method of the invention for preparing a pair of veneers with identical unstraight grains.

Still another method for preparing a pair of veneers with identical unstraight grains is shown in FIG. 10. The method of FIG. 10 is substantially the same as the method of FIG. 8 except that a circular saw 10 makes slits 30 in a log 1 along the axial direction thereof with predetermined intervals along the circumference of the log before the log is peeled. A rotatable guide member 20 controls the saw 10 such that the saw 10 makes a slit 30 to a depth equal to twice the thickness of each one of a pair of veneers to be prepared. The saw 10 is movable not only axially, but radially of the log. After the slit 30 has been made in the log, the log is rotated by the angle corresponding to the predetermined length of each one of a pair of veneers to be prepared. Then, another slit 30 with the foregoing depth is made in the log by the saw 10. Then, the log is peeled by the knife 24 from the middle of the depth of the first slit to the middle of the depth of the second slit while the log is rotated. Thus, one of a pair of veneers to be prepared is provided. Thereafter, the operation of making a slit in the log is alternated with the operation of peeling the log. A pressing means 23*b* is associated with the knife 24. Another knife 24*a* is located in a position diametrically opposed to the knife 24. A pressing means 23*c* is associated with the knife 24*a*. When the first slit has reached the position where the knife 24*a* is located, the log is peeled by the knife 24*a* from the bottom of the first slit to the bottom of the second slit as the log is rotated. Thus, a veneer with the same thickness, length and unstraight grain as the veneer peeled by the knife 24 is provided. Pairs of veneers with identical unstraight grains are prepared at a higher rate by the apparatus of FIGS. 6, 7 or 8 than by the apparatus of FIG. 10. However, like the apparatus of FIG. 6, the apparatus of FIG. 10 may be used to prepare pairs of veneers with identical unstraight veneers more easily than the apparatus of FIGS. 7 or 8.

If desired, such a cutting means as the blade 32 of FIG. 6 may be used instead of the circular saw 10.

A pair of veneers with identical unstraight grains prepared by the method of FIGS. 6, 7, 8 or 10 may be used to produce a substantially uncurved and unwaved plywood. Thus, according to the invention, logs with unstraight fibers may be effectively used.

What is claimed is:

1. A method for continuously preparing pairs of veneers with identical unstraight grains, which comprises (i) peeling from a cylindrical log with unstraight fibers a continuous sheet of twice a thickness of each one of a pair of veneers to be prepared, (ii) cutting the sheet into a predetermined length to provide a thick veneer, and (iii) slicing the thick veneer at a middle of a thickness thereof to prepare a pair of veneers with equal thicknesses and with identical unstraight grains.

2. A method for continuously preparing pairs of veneers with identical unstraight grains, which comprises (i) peeling from a cylindrical log with unstraight fibers a continuous sheet of twice a thickness of each one of a pair of veneers to be prepared, (ii) slicing the sheet continuously at a middle of a thickness thereof, and (iii) cutting the sliced portion of the sheet into a predetermined length to prepare a pair of veneers with equal thicknesses and with identical unstraight grains.

3. A method for continuously preparing pairs of veneers with identical unstraight grains, which comprises (i) peeling a first continuous layer of a predetermined thickness from a cylindrical log with unstraight fibers at a position adjacent to a circumference of the log, (ii) cutting the peeled layer into a predetermined length to provide a first veneer, (iii) peeling a second continuous layer of the same thickness as the first continuous layer which has extended along the first continuous layer in a position immediately inside the first continuous layer, from the log at another position adjacent to the circumference of the log, the first and second continuous layers being peeled while the log is continuously rotated, and (iv) cutting the second continuous layer into the same length as the first continuous layer which starts from a position thereof corresponding to a position where a leading edge of the first veneer has been located, thereby producing a second veneer with an unstraight grain identical to the unstraight grain of the first veneer.

4. A method for continuously preparing pairs of veneers with identical unstraight grains, which comprises (i) making slits of depths equal to twice a thickness of each one of a pair of veneers to be prepared, in a cylindrical log with unstraight fibers along an axial direction thereof with predetermined intervals along a circumference of the log, (ii) peeling the log from a middle of the depth of a first slit thereof to a middle of the depth of a second slit thereof at a position adjacent to the circumference of the log, thereby providing a first veneer, and (iii) peeling the log from a bottom of the first slit to a bottom of the second slit at another position adjacent to the circumference of the log, thereby producing a second veneer with the same length, thickness and unstraight grain as the first veneer.

5. A method of continuous manufacturer of pairs of veneers with identical unstraight grains, comprising the steps of:

cutting peeled wood into sheets of a predetermined length, conveying a wooden sheet of the predetermined length between a wheel with teeth, which is disposed on one side of the wooden sheet and is driven to rotate, and a control member, which is disposed at a position corresponding to the wheel on the other side of the wooden sheet, and splitting the wooden sheet in the middle of its width with a blade which is placed downstream from the wheel and the control member and has a cutting edge facing the conveying direction of the wooden sheet.

6. A method of continuous manufacture of pairs of veneers with identical unstraight grains, comprising the steps of:

conveying a long sheet of peeled wood between a wheel with teeth, which is disposed on one side of the wooden sheet and is driven to rotate, and a control member, which is disposed at a position corresponding to the wheel on the other side of the wooden sheet, splitting the wooden sheet in the middle of its width with a blade which is placed downstream from the wheel and the control member and has a cutting edge facing the conveying direction of the wooden sheet, and cutting the wooden sheet into veneers of a predetermined length.

7. A method of continuous manufacture of pairs of veneers with identical unstraight grains, comprising the steps of:

cutting peeled wood into sheets of a predetermined length, conveying a wooden sheet of the predetermined length between a pair of wheels with teeth, which are arranged at the corresponding positions on opposite sides of the wooden sheet and rotate in different directions, and splitting the wooden sheet in the middle of its thickness with a blade which is placed downstream from the wheel and has a cutting edge facing the conveying direction of the wooden sheet.

8. A method of continuous manufacture of pairs of veneers with identical unstraight grains, comprising the steps of:

conveying a long sheet of peeled wood between a pair of wheels with teeth, which are arranged at the corresponding positions on opposite sides of the wooden sheet and rotate in different directions, splitting the wooden sheet with a blade which is placed downstream from the wheels and has a cutting edge facing the conveying direction of the wooden sheet, and cutting the wooden sheet into veneers of a predetermined length.

9. A method of continuous manufacture of pairs of veneers with identical unstraight grains, comprising the steps of:

revolving a log between a pair of wheels with teeth, which are disposed substantially on the opposite sides of the log and rotate in different directions, peeling a pair of long sheets of a predetermined width from the log with a pair of blades, each blade being arranged in the vicinity of the wheel and having a cutting edge facing the revolving direction of the log, while pressing the log with a pair of pressing members, and cutting each sheet of the predetermined width into veneers of a fixed length.

10. A method of continuous manufacture of pairs of veneers with identical unstraight grains comprising the steps of:

revolving a log between a pair of wheels with teeth, which are disposed substantially on the opposite sides of the log and rotate in different directions, making cuts of a predetermined depth on the surface of the log at fixed intervals, and peeling a pair of veneers having a width equal to half the predetermined depth of said cuts and a length equal to the fixed interval from the log with a pair of blades, while pressing the log with a pair of pressing members.

11. A method of continuous manufacture of a pair of wood veneers having substantially identical unstraight grains, said method comprising the successive steps of peeling from a wood log a sheet having a thickness that is the combined thickness of the pair of veneers, slicing the peeled sheet along the thickness thereof into two paired veneers, and cutting the peeled wood into sheets of predetermined lengths, whereby the paired veneers have substantially identical grains.

12. A method of continuous manufacture of a pair of wood veneers having substantially identical unstraight grains, said method comprising the steps of separating, from a wood log, material thereof that has a thickness that is the combined thickness of the pair of veneers and forming from said separated material two sheets having substantially identical grains, and cutting the material, prior to or subsequent to separation from the log, at predetermined lengths, whereby said sheets of said lengths form said pair of veneers.

13. A method according to claim 12 wherein said cutting step comprises cutting notches along the length of the wood log at predetermined intervals about the circumference, prior to said step of separating material.

* * * * *